US007178516B2

(12) United States Patent
Carpenter

(10) Patent No.: US 7,178,516 B2
(45) Date of Patent: Feb. 20, 2007

(54) METHODS AND APPARATUS FOR AN IN-LINE DIRECT CONNECT AIR SOURCE ADAPTER

(75) Inventor: Dale Carpenter, 930 N. Portland, Gilbert, AZ (US) 85234

(73) Assignee: Dale Carpenter, Gilbert, AZ (US)

( * ) Notice: Subject to any disclaimer, the term of this patent is extended or adjusted under 35 U.S.C. 154(b) by 135 days.

(21) Appl. No.: 10/887,411

(22) Filed: Jul. 8, 2004

(65) Prior Publication Data

US 2006/0005824 A1 Jan. 12, 2006

(51) Int. Cl.
*F41B 11/32* (2006.01)

(52) U.S. Cl. ..... 124/74

(58) Field of Classification Search ..... 124/74; 137/505.25
See application file for complete search history.

(56) References Cited

U.S. PATENT DOCUMENTS

| | | | | |
|---|---|---|---|---|
| 2,411,667 | A * | 11/1946 | Mowrey | 166/181 |
| 3,025,845 | A * | 3/1962 | Cardia et al. | 124/70 |
| 4,383,552 | A * | 5/1983 | Baker | 138/46 |
| 4,817,667 | A * | 4/1989 | Hagar | 137/613 |
| 5,613,483 | A * | 3/1997 | Lukas et al. | 124/73 |
| 5,755,213 | A * | 5/1998 | Gardner et al. | 124/73 |
| 5,957,119 | A * | 9/1999 | Perry et al. | 124/73 |
| 6,240,943 | B1 * | 6/2001 | Smith | 137/1 |
| 6,405,722 | B2 * | 6/2002 | Colby | 124/74 |
| 6,474,325 | B2 * | 11/2002 | Rice et al. | 124/71 |
| 6,539,969 | B1 * | 4/2003 | Sullivan | 137/15.18 |
| 6,543,475 | B2 * | 4/2003 | Colby | 137/505.25 |
| 6,675,791 | B1 * | 1/2004 | Alexander et al. | 124/71 |
| 6,851,447 | B1 * | 2/2005 | Carroll | 137/505.25 |
| 6,941,938 | B2 * | 9/2005 | D'Arcy et al. | 124/76 |
| 6,959,703 | B1 * | 11/2005 | Spurlock et al. | 124/74 |
| 6,983,761 | B2 * | 1/2006 | Henley et al. | 137/505.25 |
| 2001/0050076 | A1 * | 12/2001 | Colby | 124/74 |
| 2002/0046748 | A1 * | 4/2002 | Hernandez | 124/73 |
| 2002/0096164 | A1 * | 7/2002 | Perrone | 124/77 |
| 2002/0104524 | A1 * | 8/2002 | Reible | 124/73 |
| 2003/0034021 | A1 * | 2/2003 | Gabrel | 124/71 |
| 2003/0178018 | A1 * | 9/2003 | Cherry | 124/76 |
| 2003/0226555 | A1 * | 12/2003 | Reible | 124/73 |
| 2004/0003848 | A1 * | 1/2004 | Callies | 137/505.25 |
| 2004/0107951 | A1 * | 6/2004 | D'Arcy et al. | 124/74 |
| 2005/0115549 | A1 * | 6/2005 | Jones | 124/56 |
| 2005/0115552 | A1 * | 6/2005 | Dobbins | 124/73 |
| 2006/0000510 | A1 * | 1/2006 | Henley et al. | 137/495 |
| 2006/0005824 | A1 * | 1/2006 | Carpenter | 124/74 |

* cited by examiner

*Primary Examiner*—Troy Chambers
(74) *Attorney, Agent, or Firm*—Letham Law Firm LLC; Lawrence Letham

(57) ABSTRACT

Methods and apparatus for connecting a high-pressure fluid source to a paintball marker using an adapter that may have in-line inlet and outlet and connect directly to the paintball marker.

16 Claims, 3 Drawing Sheets

METHODS AND APPARATUS FOR AN IN-LINE DIRECT CONNECT AIR SOURCE ADAPTER

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention generally relates to pneumatic connectors, and more particularly, systems and methods for connecting a fluid source to a paintball marker.

2. Description of Related Art

Paintball markers use a high-pressure fluid source to operate. Paintball markers use an Air Source Adapter (ASA) to connect the bottle that contains the high-pressure fluid to the hose that supplies the marker with pressurized fluid. In addition, the ASA may be used to connect the bottle to the marker. Some ASAs connect directly to the marker, but the hose connection to the marker is not in-line with the bottle; it exits from the side of the ASA. In other ASAs, the hose that connects to the marker is in-line with the bottle, but the ASA does not connect directly to the marker, but uses a connecting device, for example, a drop forward, that connects between the ASA and the marker. Hose connectors that are not in-line with the bottle make the air system more bulky. ASAs that required a connecting device increase cost.

BRIEF SUMMARY OF THE INVENTION

The invention overcomes the limitations and problems of the prior art by providing an improved Air Source Adapter (ASA) that may connect directly to the marker and may have the hose in-line with the bottle. In one embodiment, passages connect the bottle inlet to the hose outlet and bypass the structure connecting the ASA to the marker.

BRIEF DESCRIPTION OF THE SEVERAL VIEWS OF THE DRAWING(S)

A more complete understanding of the present invention may be derived by referring to the detailed description and claims when considered in connection with the Figures, wherein like reference numbers refer to similar elements throughout the Figures, and:

DETAILED DESCRIPTION OF EXEMPLARY EMBODIMENTS

The detailed description of exemplary embodiments of the invention herein makes reference to the accompanying drawings, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

For the sake of brevity, conventional aspects may not be described in detail herein. Furthermore, the component positions shown in the various figures contained herein are intended to represent exemplary functional relationships and/or physical couplings between the various elements. It should be noted that many alternative or additional functional relationships or physical connections may be present in a practical system.

As will be appreciated by one of ordinary skill in the art, the present invention may be embodied as a customization of an existing system, an add-on product, a stand alone system, and/or a distributed system. Accordingly, the present invention may take the form of an entirely hardware embodiment, or an embodiment combining aspects of both software and hardware.

Figure 1:
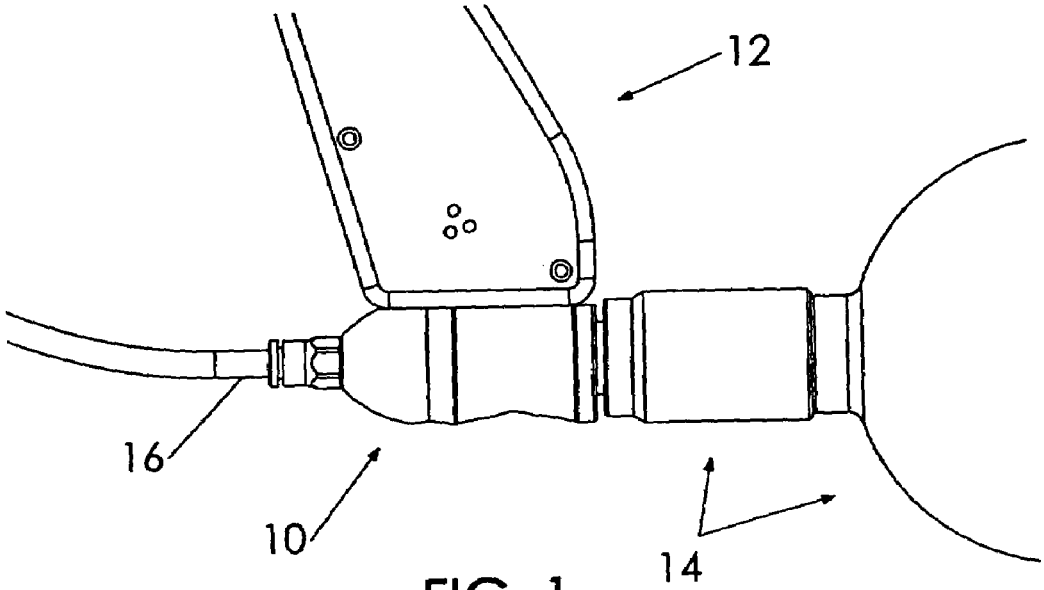
FIG. 1 is a diagram of a side view of an exemplary ASA attached to a bottle, a marker and a hose.
Figure 2:
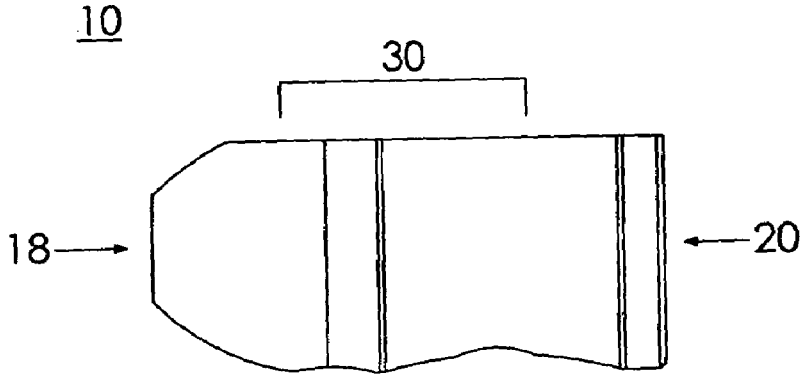
FIG. 2 is a diagram of a side view of an exemplary ASA.
Figure 3:
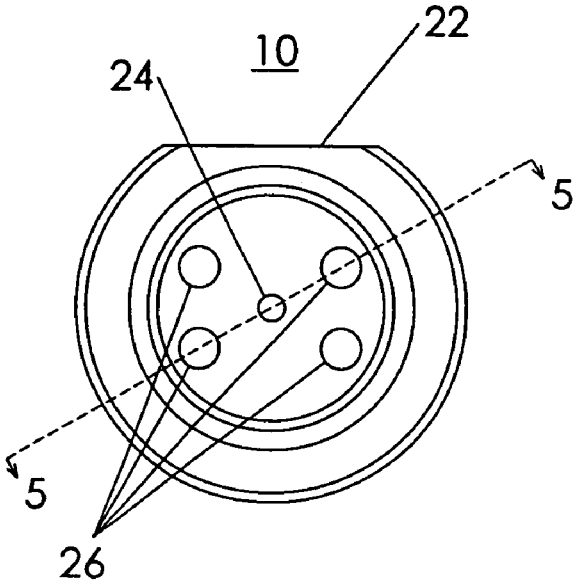
FIG. 3 is a diagram of a view an inlet end of an exemplary ASA.
Figure 4:
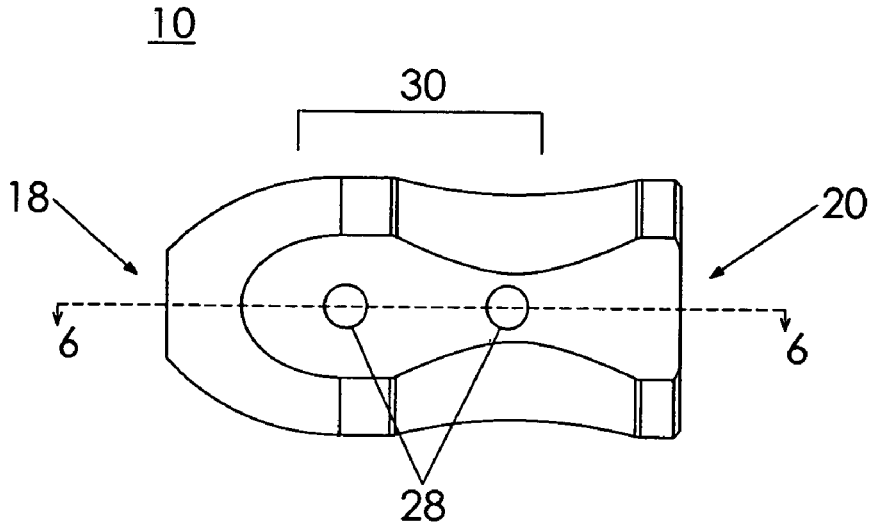
FIG. 4 is a diagram of a top view of an exemplary ASA.
Figure 5:
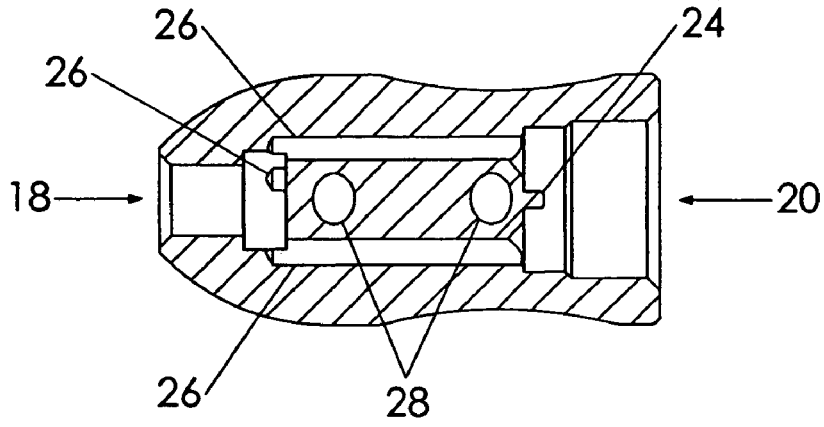
FIG. 5 is a diagram of a cross-sectional view of the exemplary ASA of FIG. 3 taken along the line 5—5.

Now turning to exemplary ASA embodiments. Referring to FIG. 1, exemplary ASA 10 may attach to a marker 12. A bottle 14 may attach to an inlet of an exemplary ASA and a hose may attach to an outlet of an exemplary ASA. As shown in FIG. 2, an inlet 20 may be in-line with an outlet 18. In another embodiment, the inlet may be axial to the outlet. A view of an exemplary embodiment looking into an inlet is shown in FIG. 3. In one embodiment, the top 22 of an ASA may be flat to abut to a marker. In another embodiment, the top of the ASA may be at least one of concave, convex, grooved, or irregularly shaped. There are no limitations on how the bottle valve may be opened to provide high-pressure fluid to the inlet. In one embodiment, pin 24 may open a bottle valve; thereby allowing high-pressure fluid to exit the bottle into the inlet. In another embodiment, the pin 24 is about 80/1000 of an inch in diameter and about 100/1000 of an inch in height. In another embodiment, the bottle may have a separate valve that controls fluid flow. Fluid communication between the inlet and the outlet may be accomplished in any manner. In one embodiment, referring to FIG. 5, passages 26 may connect the inlet to the outlet; thereby allowing high-pressure fluid to pass from the bottle to the outlet. The passages 26 may be routed through a connecting structure 30 provided to connect the ASA to a marker. The ASA may be connected to the marker using any method of connection. In one embodiment, referring to FIG. 4, which is a view of the top of an embodiment of an ASA, and to FIG. 5, the structure 30 between the inlet and the outlet may be used to connect the ASA to the marker. In one embodiment, holes 28 through the connecting structure may allow bolts to connect the ASA to the marker.

Figure 6:
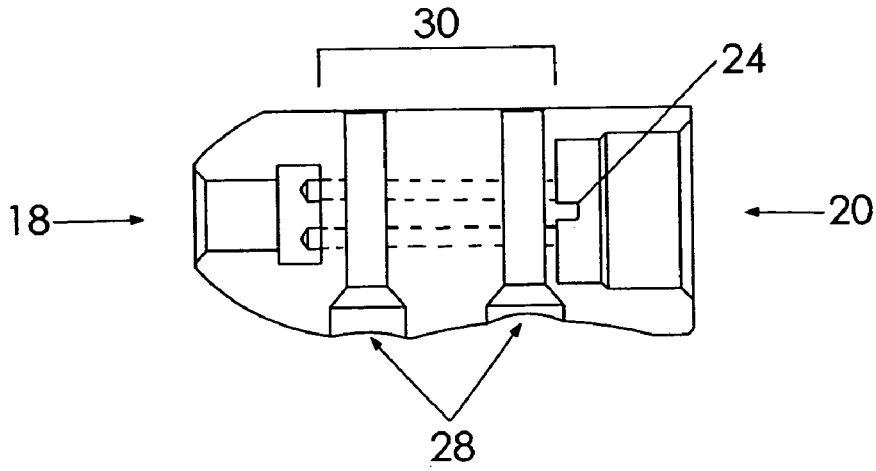
FIG. 6 is a diagram of a cross-sectional view of the exemplary ASA of FIG. 4 taken along the line 6—6.

One exemplary ASA embodiment may route the passages that provide fluid communication between the inlet and the outlet through a connecting structure used to connect the ASA to the marker. In one embodiment, shown in FIG. 5, passages 26 are routed through a connecting structure 30 and bypass holes 28 that may be a part of the connecting structure. Routing passages 26 through the connecting structure and around the holes 28 associated with the connecting structure may enable the inlet and the outlet to be closer together and still be in-line; thereby resulting in a compact ASA embodiment that may connect directly to a marker. In the embodiment shown in FIG. 5, the holes used to connect the ASA to the marker may determine the distance between the inlet and the outlet and thereby the overall size of the ASA. If the holes 28 were closer, the inlet may be in-line with and closer to the outlet; thereby resulting in a smaller ASA. If the holes 28 were farther apart, the inlet and the outlet may be at a greater distance from each other, but still be in-line. Any number of passages may route through the connecting structure to provide fluid communication between the inlet and the outlet. In one embodiment, four 125/1000 inch diameter passages may be routed through the connecting structure. In another embodiment, one 187.5/1000 inch diameter passage may be routed through the connection structure. In another embodiment, passages may bypass any holes associated with the connecting structure only on one side. The cross-section of FIG. 6 shows holes 28 that may be part of a connecting structure and the dotted lines show how the passages between inlet and outlet may bypass behind the holes that may be associated with the connecting structure. In another embodiment, the inlet and outlet may be axial to each other and the passages 26 may be routed through the connecting structure and bypass any holes associated with the connecting structure on at least one side. In another embodiment, outlets formed angularly with the ASA, in addition to the in-line outlet, may connect to one of the passages 26 and provide high-pressure fluid.

There are no limitations on how the bottle may connect to the inlet. In one embodiment, the bottle threadedly connects to the inlet. In another embodiment, the bottle threadedly connects to the inlet using a ½–NPSM thread. In another embodiment, one side of a quick disconnect union attaches to the inlet and the other side to the bottle; thereby providing a quick disconnect connection. There are no limitations on how the hose connects to the outlet. In one embodiment, a hose fitting threadedly connects to the outlet and the hose connects to the hose fitting. In another embodiment a hose fitting connects to the outlet using a ⅛" NPT thread and the hose connects to the fitting using a push-lock connection. In another embodiment, the host fitting is integrated into the outlet. In another embodiment, the hose connects directly to the outlet. In another embodiment, a quick disconnect assembly connects the hose to the outlet. In another embodiment, a valve connects to the outlet and the hose connects to the valve.

Now turning to exemplary methods of manufacture. The ASA may be manufactured using any manufacturing method. An exemplary manufacturing method may to form the ASA in a single piece. A first step of an exemplary method may be to form an inlet and an outlet. Passages may then be formed between the inlet and the outlet. Any holes in the connecting structure may then be formed in such a manner as to not intersect the passages between the inlet and the outlet. Another method may be to manufacture the ASA in sections then assemble the sections for form a whole. Any number of sections may be manufactured, for example, an inlet section, a connecting structure section, and an outlet section. Any two sections may also be integrated in manufacture; thereby requiring only two sections to form a whole. The sections may be connected using any method. Another method of manufacture may use injection molding. Another method may use casting. Another method of manufacture may be to use the winding of composite materials.

Now turning to exemplary materials. There are no limitations on the types of materials that may be used to construct an embodiment of the ASA. An exemplary embodiment may use anodized aluminum. Other embodiments may use at least one of titanium, brass, iron, steel, aluminum, composite materials, and plastic Although the description above contains many details, these should not be construed as limiting the scope of the invention but as merely providing illustrations of some of the exemplary embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described exemplary embodiments that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

What is claimed is:

1. An apparatus configured to facilitate connecting a bottle to a marker, comprising:

a body having an inlet, an outlet, and a connecting structure, wherein said inlet and said outlet are positioned axially, wherein said connecting structure is positioned between said inlet and said outlet, wherein said connecting structure has at least one hole therethrough, wherein each hole intersects the axis between said inlet and said outlet; and, at least one fluid passage formed through said connecting structure and connecting said inlet to said outlet, wherein each fluid passage is offset from and parallel to the axis between said inlet and said outlet.

2. The apparatus of claim 1, wherein the angle of intersection between each hole and the axis between said inlet and said outlet is about perpendicular.

3. The apparatus of claim 1, additionally comprising a pin positioned in said inlet configured to open a high-pressure fluid source.

4. The apparatus of claim 3, wherein said pin is less than about 81/1000 inches in diameter and less than about 101/1000 inches in height.

5. The apparatus of claim 1, wherein said connecting structure is configured to enable said body to connect directly to a paintball marker.

6. The apparatus of claim 1, wherein each of said holes is configured to enable said body to connect directly to a paintball marker.

7. The apparatus of claim 1, wherein each of said fluid passages bypasses each of said holes.

8. The apparatus of claim 7, comprising four fluid passages.

9. The apparatus of claim 1, wherein said inlet is configured to connect to at least one of a high-pressure fluid source, a quick disconnect coupler, and a valve and wherein said outlet is configured to connect to at least one of a hose fitting, a quick disconnect coupler, a hose, and a valve.

10. An apparatus configured to facilitate impelling paintballs, comprising:

a paintball marker;

a high-pressure source;

a hose; and, an adapter comprising:

a body having an inlet, an outlet, and a connecting structure, wherein said inlet and said outlet are positioned axially, wherein said connecting structure is positioned between said inlet and said outlet, wherein said connecting structure has at least one hole therethrough, wherein each hole intersects the axis between said inlet and said outlet; and, at least one fluid passage formed through said connecting structure and connecting said inlet to said outlet, wherein each fluid passage is offset from and parallel to the axis between said inlet and said outlet.

wherein said hose connects said outlet to said paintball marker, wherein said inlet connects to said high-pressure source, and wherein said connecting structure connects to said paintball marker.

11. The apparatus of claim 10, comprising four fluid passages and two holes.

12. The apparatus of claim 10, wherein said connecting structure is configured to enable said adapter to connect directly to said paintball marker.

13. The apparatus of claim 10, wherein each of said configured to enable said adapter to connect directly to a paintball marker.

14. The apparatus of claim 10, wherein each of said fluid passages bypasses each of said holes.

15. The apparatus of claim 10, additionally comprising a pin positioned in said inlet configured to open a high-pressure fluid source.

16. The apparatus of claim 9, wherein said adapter is manufactured from a single piece of aluminum.

* * * * *